United States Patent [19]

Smith

[11] 4,285,280

[45] Aug. 25, 1981

[54] RADIAL RAILWAY TRUCK

[75] Inventor: Roy E. Smith, Kingston, Canada

[73] Assignee: Urban Transportation Development Corporation Ltd., Toronto, Canada

[21] Appl. No.: 924,610

[22] Filed: Jul. 14, 1978

[30] Foreign Application Priority Data

Jul. 12, 1978 [CA] Canada ..... 307216

[51] Int. Cl.[3] ..... B61F 3/08; B61F 5/26; B61F 5/44; B61F 5/50

[52] U.S. Cl. ..... 105/168; 105/170; 105/179; 105/182 R; 105/218R

[58] Field of Search ..... 105/165, 166, 167, 168, 105/171, 179, 176, 180, 170, 182 R, 194, 224 R, 218 R

[56] References Cited

U.S. PATENT DOCUMENTS

| | | | |
|---|---|---|---|
| 135,614 | 2/1873 | Youmans | 105/168 |
| 293,265 | 2/1884 | Meatyard | 105/168 |
| 307,017 | 10/1884 | Cleveland | 105/170 |
| 356,347 | 1/1887 | Brown et al. | 105/168 |
| 444,181 | 1/1891 | Robinson | 105/168 |
| 461,680 | 10/1891 | Hunt | 105/165 |
| 638,665 | 12/1899 | Green | 105/176 |
| 667,455 | 2/1901 | Prescott | 105/168 X |
| 727,919 | 5/1903 | Ellery | 105/168 |
| 736,318 | 8/1903 | Van Kirk | 105/194 X |
| 800,035 | 9/1905 | Van Kirk | 105/167 |
| 1,051,214 | 1/1913 | Gawley | 105/168 |
| 1,064,167 | 6/1913 | Pintner | 105/165 |
| 1,138,357 | 5/1915 | Curmen | 105/165 X |
| 1,147,430 | 7/1915 | Pflager | 105/179 |
| 2,042,623 | 6/1936 | Montrose-Oster | 105/165 X |
| 2,057,930 | 10/1936 | Strauss | 105/168 X |
| 2,098,459 | 11/1937 | McWhirter | 105/182 R |
| 2,098,723 | 11/1937 | Frei | 105/168 |
| 2,103,713 | 12/1937 | Dietrich | 105/180 X |
| 2,193,046 | 3/1940 | Strauss | 105/167 X |
| 2,834,303 | 5/1958 | Furrer | 105/176 |
| 3,434,432 | 3/1969 | Seifert | 105/168 X |
| 3,862,606 | 1/1975 | Scales | 105/224 R X |

FOREIGN PATENT DOCUMENTS

| | | | |
|---|---|---|---|
| 70777 | 9/1893 | Fed. Rep. of Germany | 105/165 |
| 837711 | 5/1952 | Fed. Rep. of Germany | 105/168 |
| 917676 | 9/1954 | Fed. Rep. of Germany | 105/168 |
| 2419989 | 11/1975 | Fed. Rep. of Germany | 105/168 |
| 2624719 | 11/1977 | Fed. Rep. of Germany | 105/168 |
| 1431055 | 1/1966 | France | 105/168 |
| 1438445 | 4/1966 | France | 105/168 |
| 464379 | 4/1937 | United Kingdom | 105/168 |

*Primary Examiner*—Joseph F. Peters, Jr.
*Assistant Examiner*—Howard Beltran
*Attorney, Agent, or Firm*—Rogers, Bereskin & Parr

[57] ABSTRACT

A short wheelbase railroad truck having two axles intended to assume a radial configuration when the railroad vehicle rounds curves comprises a frame having two side members and axles mounted in bearing means. The bearing means are pivotally attached to the frame members with at least two of the bearing means being attached to the frame members by means of steering levers which are pivotally attached to the associated bearing means and the frame members for independent pivotal movement. Steering rods connect each steering lever to the vehicle body such that the chording of the vehicle as it rounds a curve will guide each axle to the radial alignment. In one embodiment each axle is guided by such steering rods and levers. In another embodiment one axle is guided by steering rods and levers and the side members move relatively longitudinally to guide the other axle.

7 Claims, 9 Drawing Figures

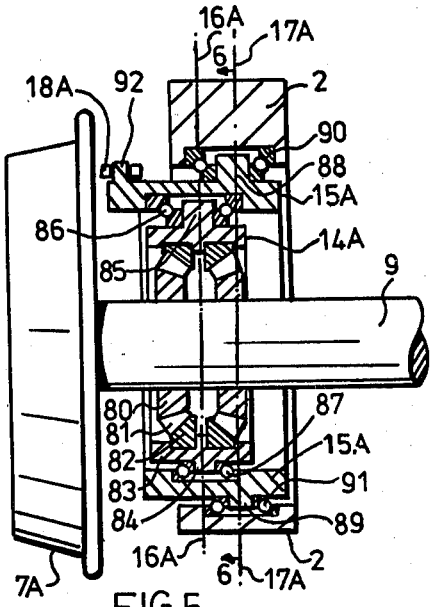
FIG. 5
FIG. 6
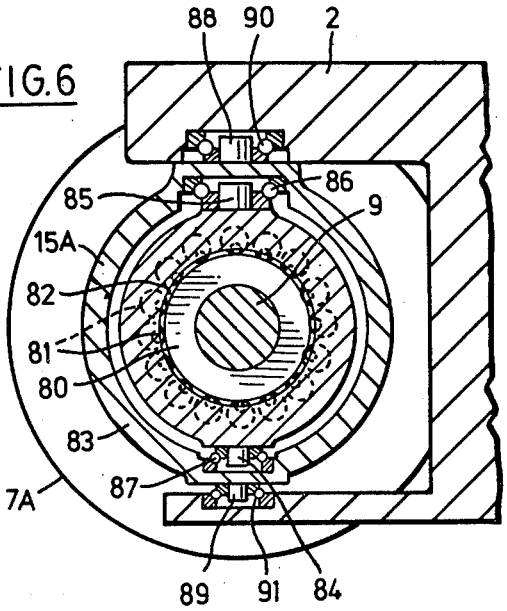
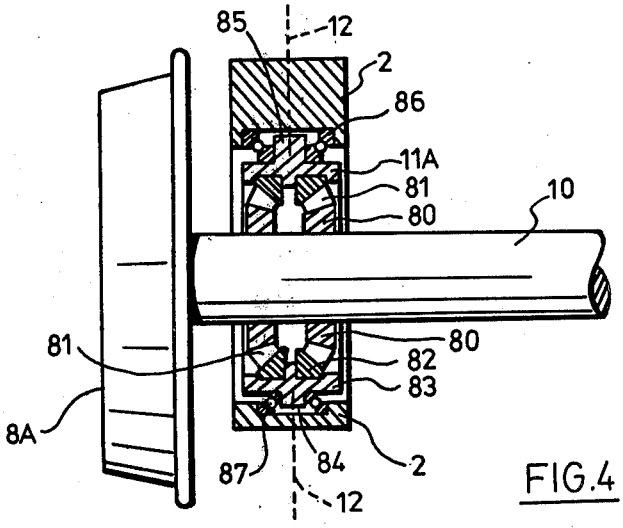
FIG. 4

RADIAL RAILWAY TRUCK

This invention relates to railway car equipment and in particular relates to an improved truck having wheel sets which will automatically go radial on curves.

Typically a railroad vehicle will comprise a pair of trucks at the vicinity of either end of the railway vehicle. Each truck will contain two axles or wheel sets. Typically a wheel set comprises a pair of flanged wheels having conical surfaces that contact the guiding rails and a single axle. Each wheel is affixed to the axle such that the wheels and axle turn at the same angular speed. With such a fixed wheel set the axle is self-aligning on the railroad track. As will be obvious to those skilled in the art the conical surface of the wheel which contacts the rail generates forces in the wheel set known as creep forces which will keep the wheel set generally perpendicular to a tangent to the rails at the point of contact. However, a single axle using conical wheels is an unstable system as is well-known to those skilled in the art and accordingly, the two axle truck has become the most popular form of truck in use today. While the two axle truck is a very stable truck, problems arise with such trucks when the vehicle rounds railway curves.

In typical trucks in use today each of the wheel sets is affixed to the truck such that the wheel sets remain substantially parallel to each other at all times. Because the wheels are not radially aligned to the track considerable extra forces are generated at the point of contact of the wheels with the rails when travelling a curve and the wheels must be made to slip with respect to the rails. This generates substantial wear at the conical surface of the wheels and also generates considerable noise which is highly objectionable in metropolitan areas.

The desirability of providing a vehicle truck having two axles wherein the axles adopt a radial position when the vehicle is rounding a curve has long been recognized. Several attempts have been made to provide trucks wherein the axles can assume the radial position. A typical example of a design for a radial truck is disclosed in the U.S. Pat. No. 293,265 to E. B. Meatyard issued Feb. 12, 1884. A more modern design is illustrated in U.S. Pat. No. 3,862,606 issued to Brian T. Scales Jan. 28, 1975. Typically, previous designs have illustrated some form of sliding or resilient contact between the wheel set and the truck frame to enable the wheel set to move relative to the truck frame to the radial position. With the use of sliding or resilient contacts relatively large forces are required to move the wheel sets to the radial position. It has also been recognized by those skilled in the art that once a truck is provided with freedom such that the wheel sets can move there will be some loss of stability in the truck and accordingly, resilient or damping means are usually required to be attached to the wheel set to assure that the wheel sets do not "hunt" while the vehicle is travelling either on a curve or on straight track.

Another typical example of a radial truck is illustrated in U.S. Pat. No., 3,789,770 to Harold A. List issued Feb. 5, 1974. List teaches use of a vehicle truck comprising two subtrucks which are pivotally attached to one another and to the main truck frame. In order to provide the required stability of the subtrucks List teaches use of resilient means located between the subtruck and the main truck frame. These resilient means are intended to give the List truck the required stability. However, at the same time, use of such resilient means requires greater forces to move the wheel set to the radial position.

It has been discovered that a radial truck which eliminates sliding contact can be both stable and relatively easily manufactured if the bearing sets supporting the axles are each pivotally mounted to the frame of the truck.

According to this invention, each of the pair of wheels sets of a truck having side frame members is mounted in two bearing means. Each of the bearing means is attached to the truck so as to provide for pivotal movement about a vertical axis of the bearing means relative to the truck. Each of at least two of the bearing means is pivotally attached to the frame by means of a pivotal attachment to a steering lever which steering lever is itself pivotally attached for pivotal movement about a vertical axis relative to the frame. Each such steering lever is pivotally attached to a steering rod and the steering rod is attached to the body of the railroad vehicle. In one aspect of the invention the side members of the frame of the truck assembly are free to move relative to one another in the longitudinal direction. With this system the reaction forces to steering of one of the axles causes relative movement of the side members of the frame which movement serves to align the other of the axles of the truck to the radial position. In a second embodiment of the invention the side members of the truck frame are fixed such that there is no relative movement between the side members of the frame. In this latter embodiment at least one bearing means of each axle of the truck is pivotally attached to respective steering levers which are pivotally attached to the side members of the frame, the steering levers being pivotally attached to steering rods which are attached to the vehicle body.

FIG. 4 is a vertical transverse section along line 4—4 of FIG. 1.

FIG. 5 is a vertical transverse section along line 5—5 of FIG. 1.

FIG. 6 is a vertical longitudinal section along line 6—6 of FIG. 5.

The vehicle truck of this invention comprises a truck frame and two wheel sets. The railroad vehicle must have at least two such trucks preferrably one at either end of the railroad vehicle. The trucks of this invention may also be used in association with an articulated vehicle or a married pair of vehicles having three such trucks. Those skilled in the art will appreciate that as the railroad vehicle, articulated or married pair, negotiates a curve the railroad vehicle body will pivot with respect to each truck. Accordingly, the truck is attached to the railroad vehicle body by means allowing for this pivotal movement. As each truck is pivoted with respect to the railroad vehicle body, the vehicle body can assume a "chord" position as the vehicle negotiates a curve. This movement of the vehicle body relative to the truck is used in this invention to guide the wheel sets to a radial position. For the purposes of describing the truck of this invention only one truck has been illustrated. It will however, be understood that more than one such truck will be attached to the railway vehicle. For the purposes of this description one of the wheel sets is referred to as the outboard axle, the other wheel set being referred to as the inboard axle. The outboard axle is the wheel set which is closest to the end of the vehicle at which the truck is attached. The inboard axle is the wheel set of the truck which is closest to the center of the vehicle.

Figure 1:
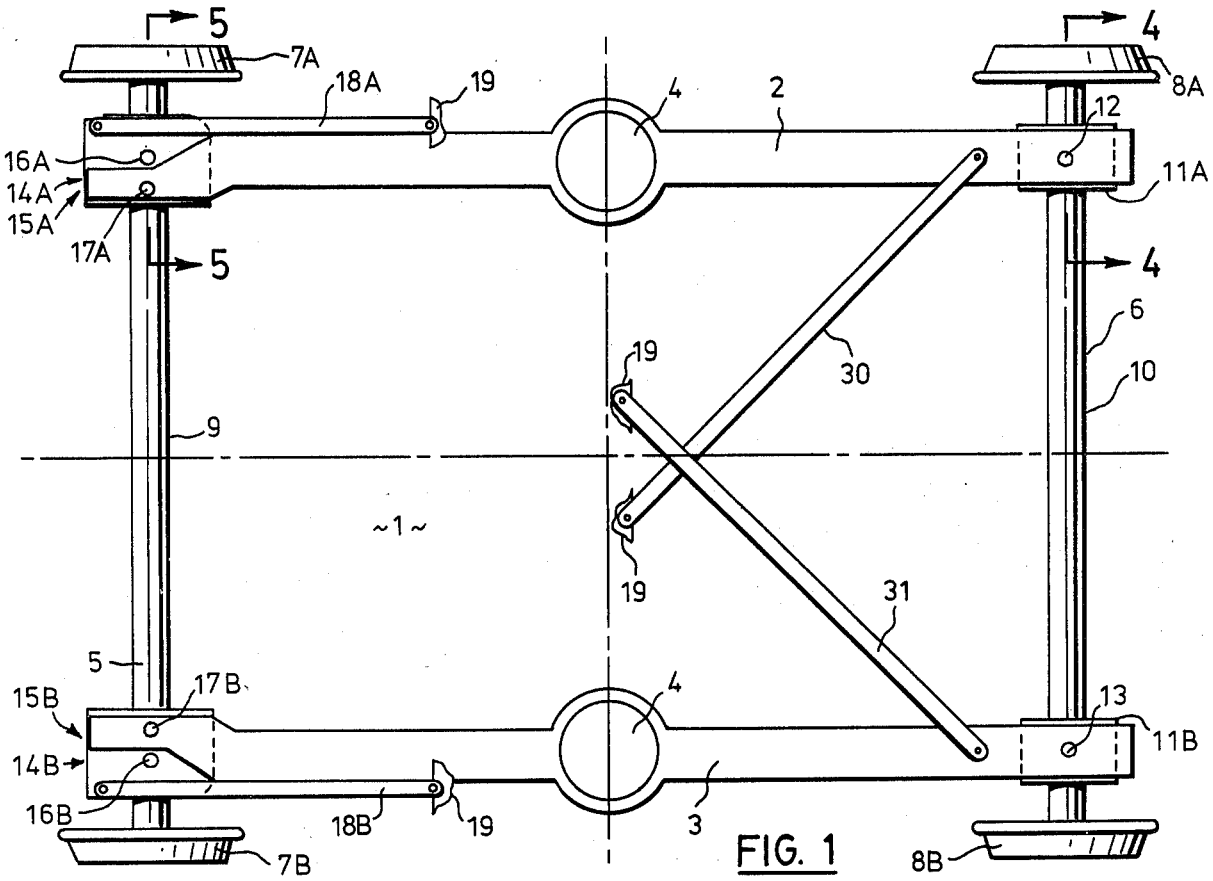
FIG. 1 is a schematic plan view of a railroad truck embodying the present invention wherein the side frames are adapted for relative movement and the inboard axle of the truck is steered by means of steering rods.

FIG. 1 illustrates a truck 1 embodying the invention wherein the side members of the truck frame can move longitudinally relative to one another and the inboard axle of the truck is steered by steering rods attached to the vehicle body. The truck comprises frame members 2 and 3. At approximately the mid-point of each of the side frame members 2 and 3 provision is made for mounting a suspension system 4. Typically, this suspension system will involve springs or similar resilient means to which is attached a cross member, not shown in FIG. 1, known as a bolster. The bolster as is well understood by those skilled in the art comprises a pivot by means of which the truck is mounted on the railroad vehicle. For the purposes of clarity the bolster has not been shown in order that a better understanding of the truck of this invention can be illustrated in the drawing. At either end of the side frame members 2 and 3 there is located the standard wheel set 5, 6 well-known to those skilled in the art. Each wheel set 5 and 6 comprises two wheels 7A, 7B, 8A, 8B and an axle 9 and 10. In this embodiment of the invention the outboard axle 10 is journaled for rotation about a horizontal axis in bearing means 11A and 11B. Each of these bearing means or housings 11A and 11B is attached to the side frame members 2 and 3 respectively for pivotal movement about respective vertical axes 12 and 13.

A suitable bearing means for accomplishing this is shown in FIG. 4 which illustrates bearing means 11A which may be pivotally attached to the side frame member 2. Bearing means 11A comprises an inner race 80, tapered roller bearings 81, outer race 82 and a housing portion 83. Projecting from housing portion 83 are two vertical journals 84 and 85. Vertical journals 84 and 85 define the pivotal axis 12. Angular contact roller bearing 86 is mounted on journal 85 to permit rotation of journal 85 with respect to frame 2. Frame member 2 may advantageously have a yoke shaped end portion the upper and lower extremities of which are shown in FIG. 4. Bearing 87, similar to bearing 85 provides for rotation of journal 84 with respect to the frame member 2. This upper and lower support of bearing means 11A is not absolutely necessary but desirable to provide appropriate support for braking and accelerating forces of the vehicle. It will also be understood by those skilled in the art that if the railroad vehicle is not intended to negotiate relatively short radius turns, self-aligning bearings could be used in place of the more complicated structure shown in FIG. 4. Self-aligning bearings will allow for a certain amount of pivotal movement of the outboard axle relative to each of the side frames 2 and 3.

The inboard axle 9 illustrated in FIG. 1 is also mounted in bearing means 14A and 14B for rotation about a horizontal axis. Each of these bearing means 14A and 14B is pivotally attached to a steering lever 15A and 15B respectively for pivotal movement between the steering lever and the bearing means about a vertical axis 16A and 16B. The steering levers 15A and 15B are also pivotally attached to the side frame member 2 and 3 respectively for pivotal movement between the steering lever and the side frame member about respective vertical axes 17A and 17B. One end of steering rod 18A and 18B is attached to the steering lever 15A and 15B for relative movement about a vertical axis. The other end of the steering rod is fixed to the vehicle body 19. It will be understood by those skilled in the art that each steering rod 18A and 18B will be fixed either directly to the vehicle body or to any other structure which is fixed to the vehicle body and which rotates with the vehicle body relative to the truck generally. In certain forms of truck the bolster previously referred to is fixed directly to the vehicle body and the bolster rotates with the vehicle body relative to the truck. If this form of bolster is used the steering rods 18A and 18B may be conveniently connected to the bolster. The significant point is that the steering rods must be connected to the portion of the vehicle which assumes the chord line effect when the vehicle is negotiating a curve.

FIGS. 5 and 6 illustrate the interconnection between bearing means 14A, steering lever 15A, steering rod 18A and frame member 2. Bearing means 14A may be identical to bearing means 11A illustrated in FIG. 4. In FIGS. 5 and 6 vertical journals 84 and 85 define axis 16A. Steering lever 15A preferably supports bearing means 14A at top and bottom as illustrated in FIG. 6. Steering lever 15A comprises upper and lower vertical journals 88 and 89 which together define axis 17A. Bearings 90 and 91 which may be similar to bearing 86 provide for rotation of steering lever 15A about axis 17A, relative to frame member 2. Frame member 2 is also preferably yoke shaped at this end to provide upper and lower support for steering lever 15A and bearing means 14A. Although this upper and lower support is not mandatory, it is desirable to provide sufficient support for braking and acceleration forces. Those skilled in the art will understand that steering lever 15A and frame member 2 will likely be split members to enable assembly of the combination. This is already well known in the industry with respect to upper and lower support of conventional trucks. Steering lever 15A further comprises journal 92. Steering rod 18A is affixed to journal 92 so as to permit relative pivotal movement between steering lever 15A and steering rod 18A. As there will be only very limited pivotal movement between these links a simple journal bearing or bushing may be used.

It will be obvious to those skilled in the art that the precise configuration of steering lever 15A, bearing means 14A and frame member 2 may be varied widely. Steering lever 15A may require slots or other clearance means to ensure that axle 9 does not contact any portion of steering lever 15A as the vehicle negotiates a curve.

Figure 7:
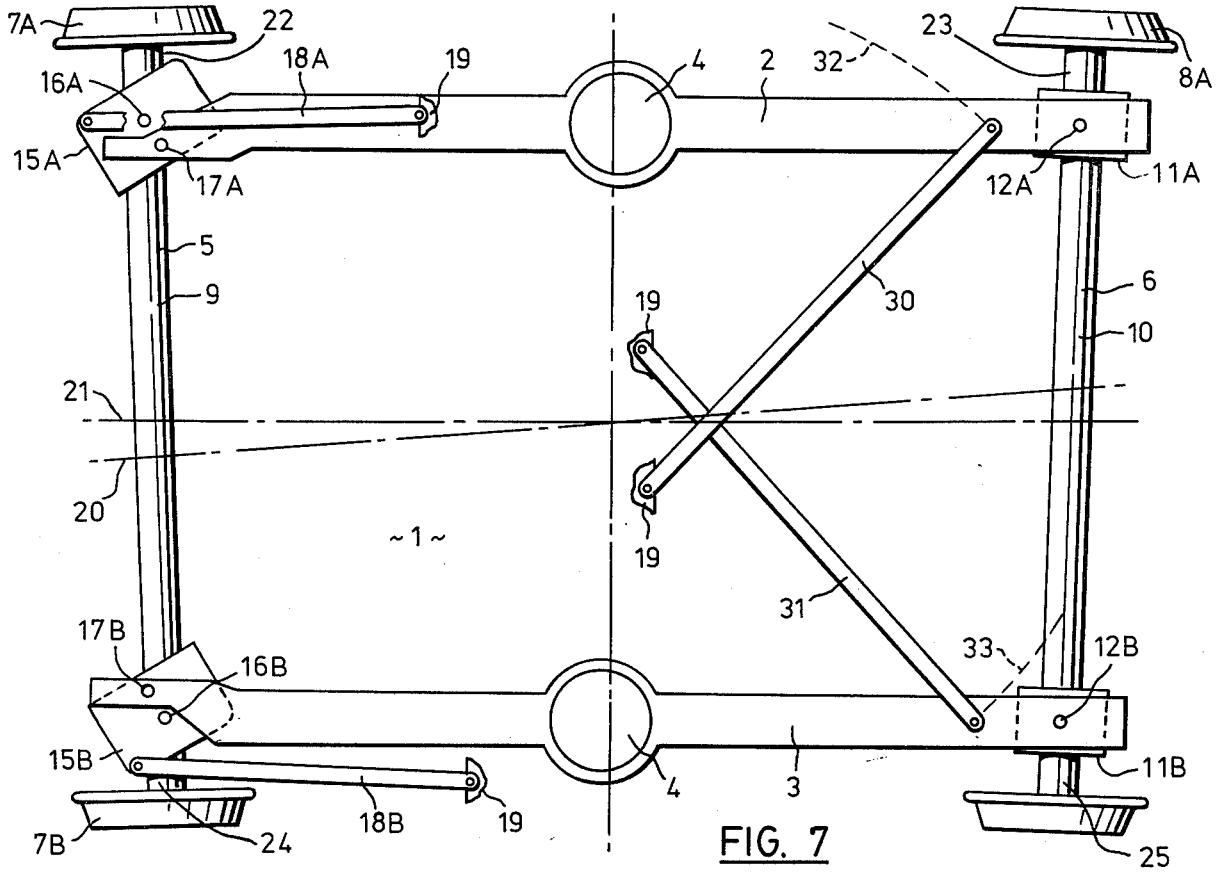
FIG. 7 is a schematic plan view of the truck of FIG. 1 when travelling on a curve.

FIG. 1 shows the alignment of all of the various parts when the vehicle is travelling in a straight line. FIG. 7 is a similar schematic plan view of the truck of FIG. 1 when the vehicle is negotiating a curve. The axis 20 of the vehicle body has rotated relative to the longitudinal axis 21 of the truck. As will be obvious in FIG. 7 the steering rods 18A and 18B have been moved by virtue of movement of the vehicle body 19 relative to the truck. One of the steering rods 18A has been put into compression while the other steering rod 18B has been put into tension. The steering lever 15A connected to steering rod 18A pivots with respect to the frame member 2 and in turn causes longitudinal movement of both the side frame member 2 and the bearing means 14A. Thus movement of the steering lever 15A causes movement of the end 22 of the axle 9 relative to the side frame member 2.

By virtue of rotation of the steering lever 15A the side frame member 2 and the end 22 of the axle 9 are moved in opposite directions. Further, by virtue of movement of the side frame member 2 in the longitudinal direction the end 23 of outboard axle 10 is moved longitudinally. Thus, the ends 22 and 23 of the axles 9 and 10 attached to this frame member 2 have been moved longitudinally apart. As steering rod 18B is in tension, a similar but opposite longitudinal displacement occurs bringing the ends 24 and 25 of the axles attached to the frame member 3 longitudinally together. Thus, the two axles 9 and 10 have each moved to a radial position.

It will be observed from a review of FIG. 7 that there are no substantial restraining forces involved in the mechanism. Accordingly, movement in this linkage which permits pure pivotal movement of all of the working parts may be accomplished without the input of substantial force. As previously explained the axles will themselves seek a radial position. By virtue of the steering effect of the chording of the vehicle body this self-steering position is maintained. It will be obvious to those skilled in the art that the relative lengths of the steering rods 18, steering levers 15, truck wheelbase, centre distance between trucks and the location of the attachment and pivot points relative to one another are all critical. It is considered that those skilled in the art will have no difficulty in establishing the correct proportions to ensure that the chording effect of the vehicle will cause each of the axles to maintain a radial configuration when the vehicle rounds a curve.

It will also be appreciated by those skilled in the art that the truck constructed according to this invention can be as stable as the more typical truck in which the axles do not assume the radial position. Because the vehicle axles are linked together one axle cannot oscillate away from the position perpendicular to the tangent to the rails without causing a similar but opposite displacement of the other axle. Because the axles are linked to the vehicle body through the steering levers no movement of either axle is possible unless the vehicle assumes the chorded position. Accordingly, the vehicle itself prevents the axles from "hunting" and stability of the system is ensured without the use of additional resilient means. It will, of course, be understood by those skilled in the art that the steering rods 18A and 18B must be of sufficient stiffness to give the required stability.

As each of the frame members is free to move longitudinally relative to one another, there is the potential for the truck of this embodiment to move to a parallelogram configuration wherein the axles 9 and 10 are parallel to one another but not perpendicular to the side frame members 2 and 3. This condition must be prevented in order for the axles 9 and 10 to each be perpendicular to the tangent to the rails. This effect known as "lozenging" will be generally understood by those skilled in the art and is prevented by the inclusion of other components in the truck such as propulsion members which give lozenge stiffness. For applications where no such components exist other means to provide this lozenge stiffness will be required. An example of such means is rods 30 and 31 shown in FIGS. 1 and 7 attached to side frame members 2 and 3 respectively. Each such rod 30 and 31 is attached to the vehicle body 19 at a point which is at the centre of the arc defined by movement of the other end of said rod relative to the vehicle body when the axles each move to the radial position. This arc 32 is shown in FIG. 7 for the particular point of attachment of the rod 30 illustrated. The arc may be plotted for any vehicle geometry and any point of attachment to either the frame or steering lever. A similar arc 33 is shown for rod 31.

FIG. 6 shows in vertical section, the bearing means 14A, steering lever 15A and side frame member 2 as used in FIG. 1. The steering lever is, of necessity, of relatively strong design as this member must carry the weight suspended on the truck. The weight carried by the truck passes from the bolster to the suspension means in the middle of the frame member. The weight is transferred to the wheel through the pivotal connection from the frame to the steering lever and through the steering lever and its pivotal connection to the bearing means and thence to the axle and wheel. Accordingly, the steering lever will of necessity be of sufficient strength to provide a relatively stiff member which in conjunction with the steering rod will prevent "hunting" of the axles.

Figure 2:
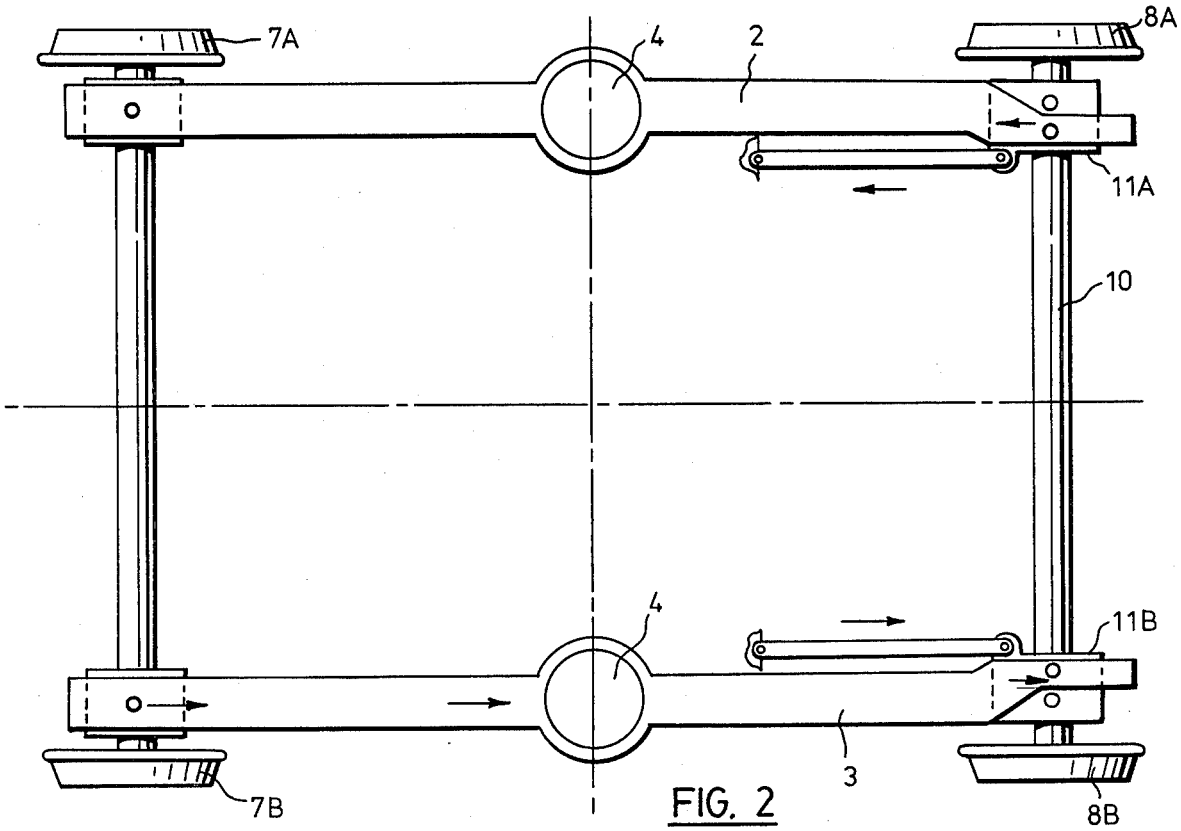
FIG. 2 is a schematic plan view of a railroad truck similar to FIG. 1 wherein the side members of the frame are adapted for relative movement and the outboard axle of the truck is steered by means of steering rods.

FIG. 2 is similar to FIG. 1. The truck shown in FIG. 2 comprises similar frame members to those shown in FIG. 1. These frame members are not fixed to one another and accordingly are free to move in the longitudinal direction relative to one another. The only difference between the truck shown in FIG. 1 and the truck shown in FIG. 2 is that the steering rods in FIG. 1 are connected to the inboard axle whereas in FIG. 2 the steering rods are connected to the outboard axle. It will be appreciated that the chording effect of the vehicle remains the same and that accordingly the steering levers must be reversed when comparing FIG. 1 and FIG. 2. In FIG. 2 the steering rods are on the inside of the frame members in order to accomplish the reverse effect required by steering the outboard axle. The bearing means and steering levers shown in FIG. 2 are similar to those shown in FIG. 1 the only difference being the location of the axis of the pivot points. As will be obvious to those skilled in the art, an analysis of the truck shown in FIG. 2 similar to that described above with regard to FIG. 1 shows that the vehicle on entering a curve will create a tensile stress in one steering rod and a compressive stress in the other steering rod. The resulting displacements of the ends of the axles is similar to that explained above with regard to a steering inboard axle.

Figure 3:
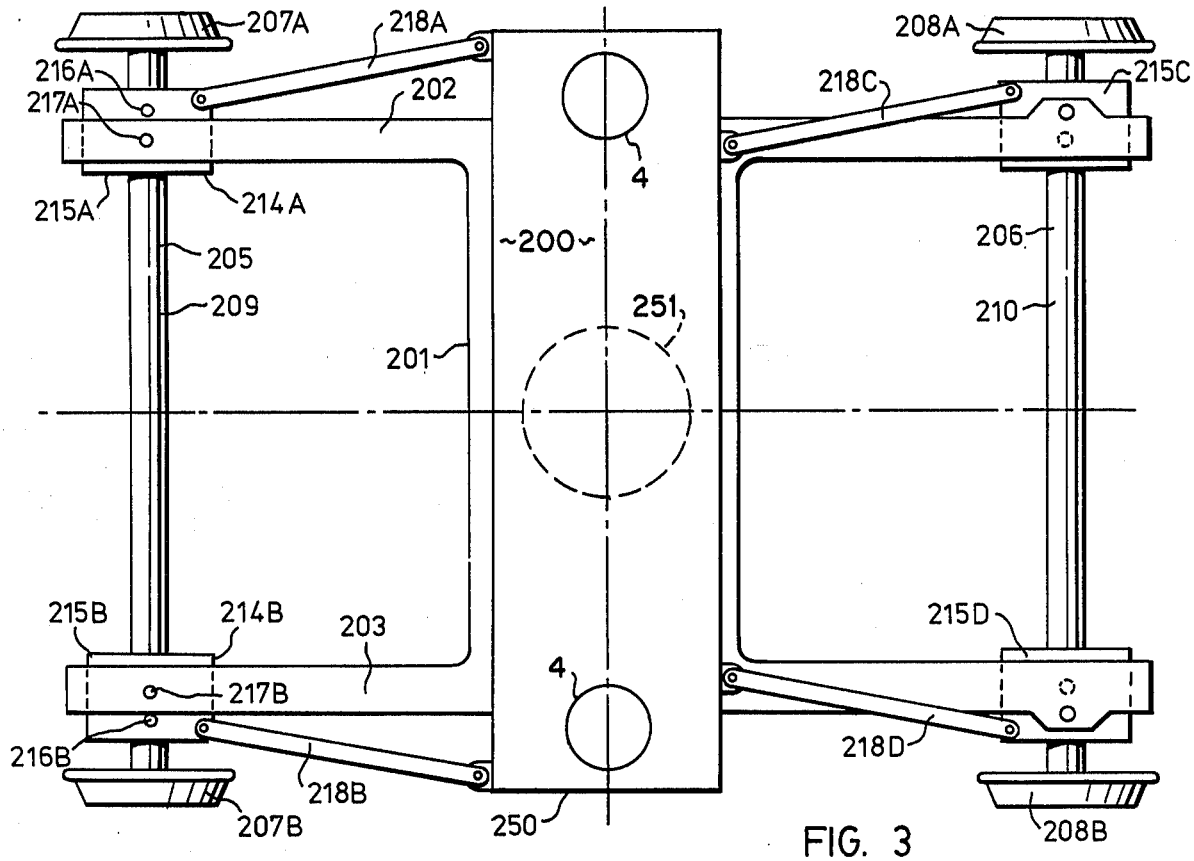
FIG. 3 is a schematic plan view of a railroad truck embodying the present invention using a frame that is rigid.

The embodiment of the invention shown in FIG. 3 makes use of a fixed truck frame. In this embodiment the frame shown generally as 200 comprises side members 202 and 203 and a stiff central portion 201 joining the two side frames. By virtue of the portion 201 joining the side frames 202 and 203 it will be appreciated that the side frames 202 and 203 may not move relative to one another. With this type of frame the vehicle body is normally equipped with a bolster shown in the diagram schematically as 250. The under portion of the bolster will contain the well-known pivot means for joining the bolster 250 to the cross member 201 of the frame. Accordingly, when the truck shown in FIG. 3 enters a curve the bolster 250 will pivot with respect to the frame 200 and this pivotal movement of the bolster is used to maintain alignment of the axles 209 and 210 in the radial position. The truck assembly 200 comprises inboard wheel set 205 comprising axle 209 and wheels 207A and 207B and outboard wheel set 206 comprising axle 210 and wheels 208A and 208B. Each of the axles 209 and 210 is supported in bearing means 214 similar to those described above as 14A with reference to FIGS. 5 and 6. With use of the fixed frame it becomes necessary to ensure that at least one of the bearing means supporting each of the axles 209 and 210 is affixed to steering levers 215 such that there is pivotal movement between the steering lever and the bearing means as explained hereinbefore. It shall be understood that each of the steering levers 215 is essentially similar although the pivot points may be located differently at each end of the truck in order to ensure that the axles move in opposite directions so as to each be radial. These steering levers may be similar to steering levers 15 illustrated in FIG. 1, FIG. 5 and FIG. 6.

Figure 9:
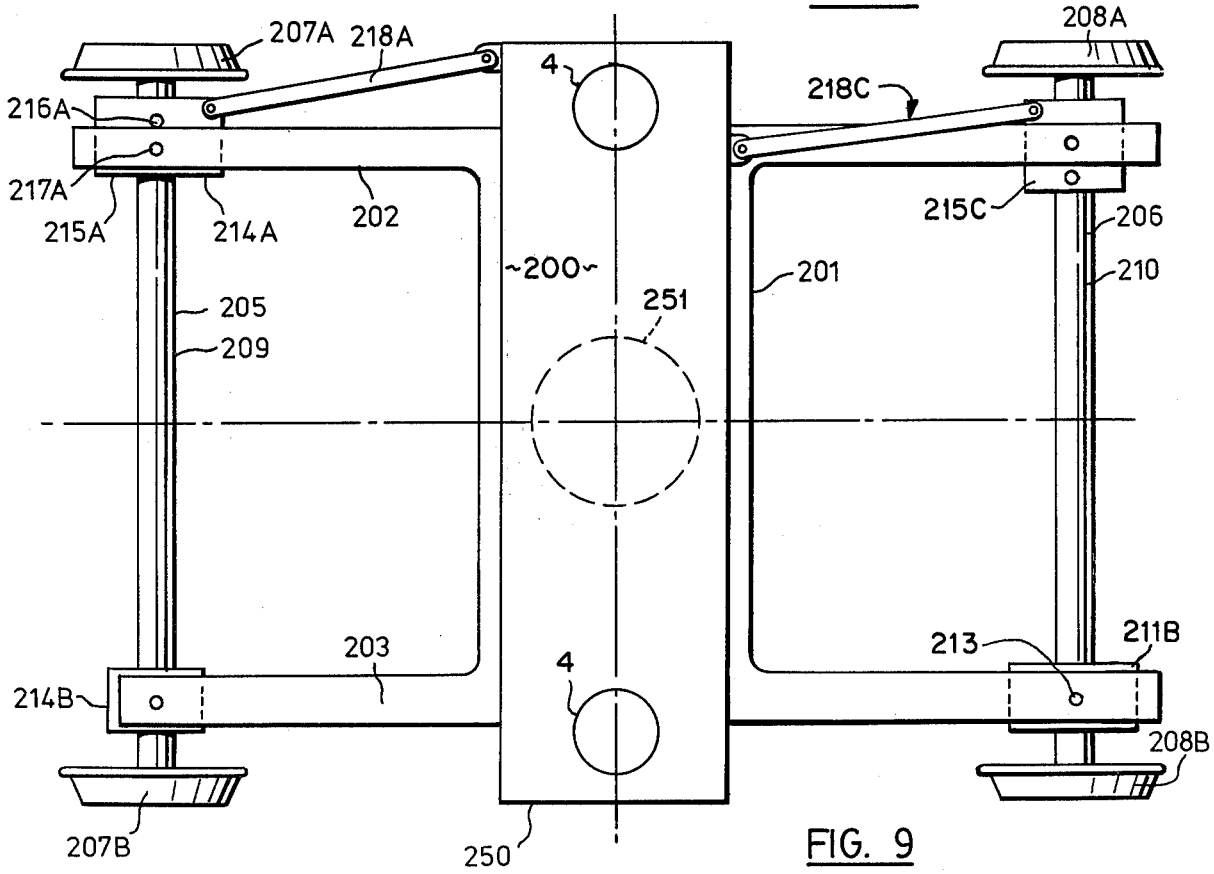
FIG. 9 is a schematic plan view of a railroad truck embodying an alternative form of the present invention using a frame that is rigid.

FIG. 3 illustrates a fixed frame truck in which all four bearing means are pivotally connected to steering levers 215A, 215B, 215C and 215D respectively. FIG. 9 illustrates a further modification of the fixed frame truck where only one end of each axle 209 and 210 is mounted in bearing means pivotally attached to a steering lever 215. In this embodiment the other end of each axle is mounted in bearing means 214B and 211B respectively which means is pivotally attached directly to the frame 200. These bearing means are essentially similar to bearing means 11A as described and illustrated in FIG. 4.

In each embodiment of the fixed frame truck the steering levers 215 are attached to the bolster by means of steering rods 218. These steering rods are attached to the bolster at one end and to the associated steering lever at the other end. The steering rods 215 could be attached to the vehicle body directly.

In the trucks shown in FIGS. 3 and 9 no use is made of the reaction force on the frame members 202 and 203. Rather than use of the reaction forces the two axles are steered directly from the pivoting of the bolster or vehicle body relative to the truck. It will, however, be realized that this system, similar to that discussed in detail with regard to FIGS. 1 and 2, accomplishes exactly the same purpose. Neither axle can pivot about a vertical axis from alignment perpendicular to the tangent to the rails as to do so would require rotation in the opposite direction of the other axle and deviation by the vehicle body from its position determined by the rails. The system is therefore stable as long as the steering rods are relatively stiff. The system operates in substantially the same manner as shown in FIG. 1 in that the axles are free to move without restraint to the radial position when the vehicle body assumes the "chorded" position. Lozenge stiffness is automatically provided in the fixed frame embodiments of FIGS. 3 and 9 by virtue of the stiff central portion 201 of the frame 200. As with the other embodiments described herein, it will be obvious to those skilled in the art that the relative lengths of the steering rod 218, steering lever 215, truck wheelbase, centre distance between trucks and the location of the attachment and pivot points relative to one another are all critical. It is considered that those skilled in the art will have no difficulty in establishing the correct proportions to ensure that the "chording" effect of the vehicle will cause each of the axles to maintain a radial configuration when the vehicle rounds a curve.

Figure 8:
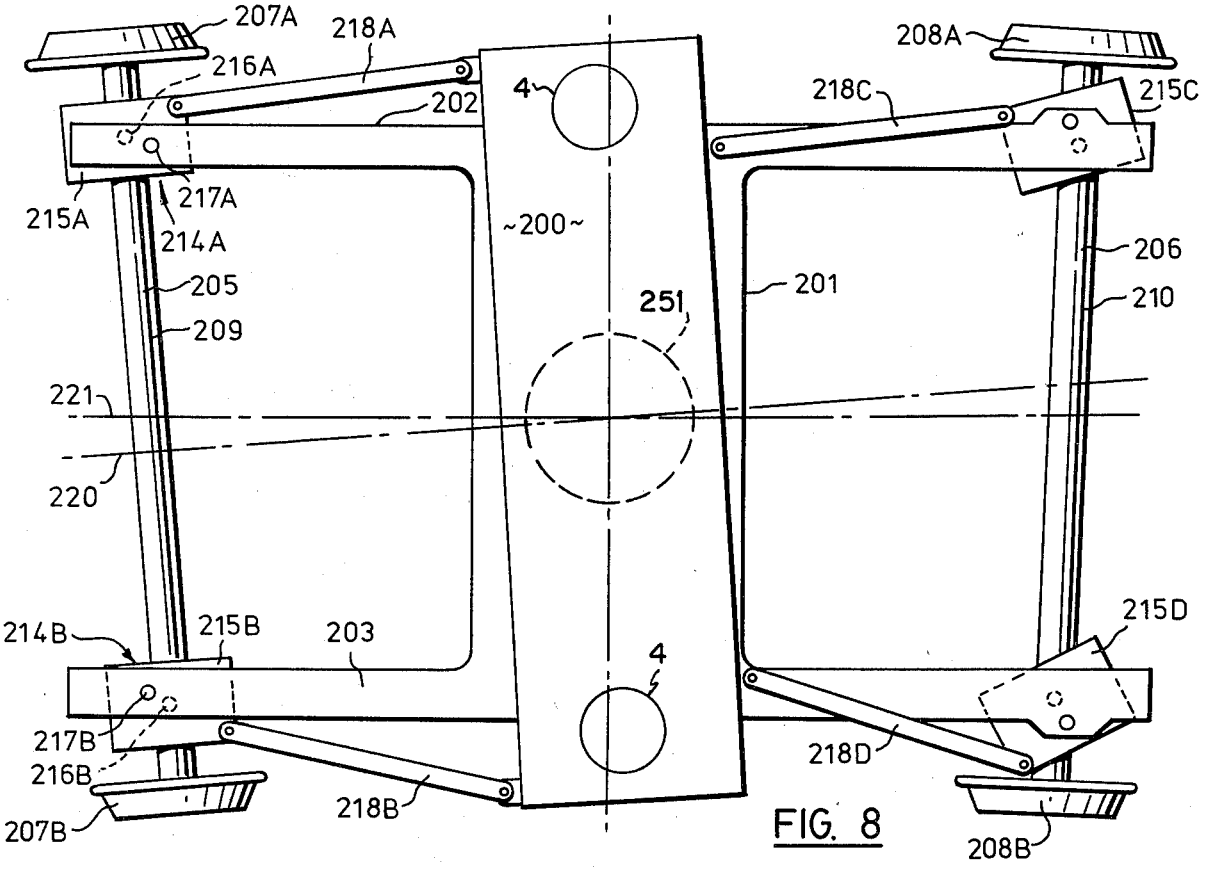
FIG. 8 is a schematic plan view of the truck of FIG. 3 when travelling on a curve.

FIG. 8 is similar to FIG. 3 and shows the truck of FIG. 3 when the vehicle is negotiating a curve. It will be obvious that each of the ends of the axles of the truck has been moved by virtue of the pivotal movement of the bolster relative to the fixed frame and the pivotal movement of the steering levers. The amount of movement of the axle is controlled by the length of the various members and location of the pivot points relative to one another. Again it can be appreciated that with this embodiment there is no sliding contact. Each axle is prevented from "hunting" by virtue of its coupling to the other axle and to the body of the railroad vehicle by means of the bolster and steering mechanism. Accordingly, as long as the steering rods are of sufficient stiffness the stability of the system is provided by the vehicle body.

The weight of the vehicle is applied to the bolster and is transferred from the bolster to the truck frame. The load is then passed through the pivot point from the frame to the steering lever and from the steering lever to the bearing means through the pivot point between the bearing means and steering lever. As the steering levers carry the weight of the vehicle they will necessarily be strong enough to satisfy any stability requirements.

While four specific embodiments of the invention have been described herein it is considered that those skilled in the art will appreciate that various modifications may be made to the geometry and form of the steering members described herein.

If desired the steering rod described herein could take the form of a hydraulic cylinder. Movement of the hydraulic cylinder could then be governed by any sutiable form of sensing system which can sense the degree of "chording" or amount of relative rotation between the vehicle body and the truck. Such sensing system could also take the form of a hydraulic actuator.

I claim:

1. A self steering truck for use in association with a railway vehicle, comprising a first axle, a second axle and frame members extending between said axles; said first and said second axle each having a pair of flanged wheels fixed thereto, each of said axles mounted in a plurality of bearing means for rotation about a generally horizontal axis, each of at least two of said bearing means being attached to said frame members by means of a steering lever; each of said steering levers being attached to said frame members and to said bearing means for pivotal movement about generally vertical axial pivots which axial pivots are horizontally spaced from each other; a steering rod being attached to each of said steering levers and adapted to be attached to the railway vehicle, the other of said bearing means being attached to said frame members for pivotal movement about respective generally vertical axial pivots.

2. The truck of claim 1 including means for permitting relative longitudinal movement between said frame members.

3. The truck of claim 1 wherein at least one bearing means of each axle is attached to said frame members by means of one of said steering levers and wherein said frame members are rigidly affixed to one another and include means for preventing relative longitudinal movement.

4. A self steering truck for use in association with a railway vehicle comprising a first axle and a second axle and having at least two frame members extending between said axles, each of said axles having a pair of flanged wheels fixed thereto, each of said axles mounted in a plurality of bearing means for rotation about a generally horizontal axis, a steering lever pivotally attached to each of the bearing means of at least one of said axles to permit relative pivotal movement about a generally vertical axial pivot, each of said steering levers attached to one of said frame members for relative pivotal movement between said frame member and said steering lever about a generally vertical axial pivot horizontally spaced from the axial pivot of the bearing means, a steering rod attached to each of said steering levers for relative pivotal movement about a generally vertical axial pivot, each of said steering rods being attached to said vehicle, said bearing means of the other of said axles being attached to said frame members for relative pivotal movement between said bearing means and said frame members about a generally vertical axial pivot, whereby said first and said second axles assume a radial position when the railway vehicle travels a curve.

5. The truck of claim 4 including means for permitting relative longitudinal movement between said frame members.

6. A self steering truck for use in association with a railway vehicle comprising a first axle and a second axle and having frame members extending between said axles, said first and said second axle each having a pair of flanged wheels fixed thereto, each of said axles mounted in a plurality of bearing means for rotation about a generally horizontal axis; steering levers pivotally attached to each of said bearing means to permit relative pivotal movement about a generally vertical axial pivot, each of said steering levers being attached to said frame members for relative pivotal movement between said frame member and said steering lever about a generally vertical axial pivot spaced from the axial pivot of the bearing member, a steering rod attached to each of said steering levers for relative pivotal movement about a generally vertical axial pivot, each of said steering rods adapted to be attached to the railway vehicle, whereby said first and said second axle assume a radial position when the railway vehicle travels a curve.

7. The truck of claim 6 wherein said frame members are rigidly affixed to one another and include means for preventing relative longitudinal movement.

* * * * *